US005234055A

United States Patent [19]

Cornette

[11] Patent Number: 5,234,055

[45] Date of Patent: Aug. 10, 1993

[54] WELLBORE PRESSURE DIFFERENTIAL CONTROL FOR GRAVEL PACK SCREEN

[75] Inventor: H. Mitchell Cornette, Houston, Tex.

[73] Assignee: Atlantic Richfield Company, Los Angeles, Calif.

[21] Appl. No.: 774,393

[22] Filed: Oct. 10, 1993

[51] Int. Cl.[5] ..... E21B 43/10

[52] U.S. Cl. ..... 166/278; 166/51; 166/205; 166/296; 166/376

[58] Field of Search ..... 166/296, 376, 278, 51, 166/227, 317, 205, 157, 158

[56] References Cited

U.S. PATENT DOCUMENTS

| | | | |
|---|---|---|---|
| 1,912,578 | 6/1933 | Halliburton | 166/205 X |
| 2,224,630 | 12/1940 | Dean et al. | 166/205 |
| 2,513,944 | 9/1950 | Kessler | 166/278 |
| 2,891,623 | 6/1959 | Boss | 166/205 |
| 3,333,635 | 8/1967 | Crawford | 166/296 X |
| 3,880,233 | 4/1975 | Muecke et al. | 166/205 |
| 3,999,608 | 12/1976 | Smith | 166/278 |
| 4,202,411 | 5/1980 | Sharp et al. | 166/296 X |
| 4,671,359 | 6/1987 | Renfro | 166/312 |
| 4,744,420 | 5/1988 | Patterson et al. | 166/312 |
| 5,036,920 | 8/1991 | Cornette et al. | 166/278 |
| 5,062,484 | 11/1991 | Schroeder et al. | 166/278 |

*Primary Examiner*—Hoang C. Dang
*Attorney, Agent, or Firm*—Michael E. Martin

[57] ABSTRACT

Under-balanced or potential fluid cross-flow conditions in a wellbore are minimized during installation of an auger-type gravel pack screen by placing a quantity of fine salt, calcium carbonate paste, a fluid loss control gel or sand within the interior space of the screen liner so that the material will form a substantially impermeable barrier on the liner, the gravel packing or the face of the formation during or after installation of the screen to minimize fluid flow in wells which have a relatively high pressure gradient. The material may be removed at will by circulation of a dissolving liquid such as fresh or unsaturated water or mechanical removal of insoluble material such as sand.

1 Claim, 1 Drawing Sheet

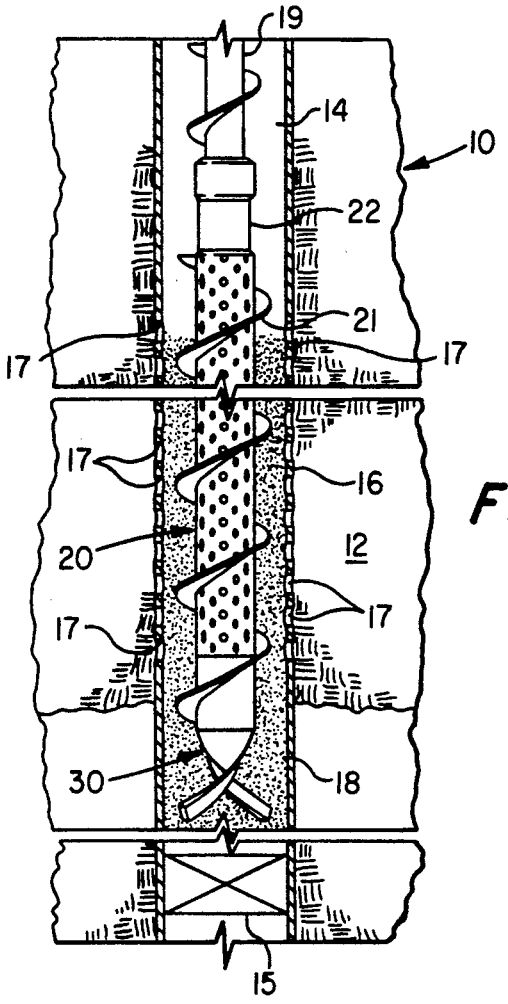
FIG. 1
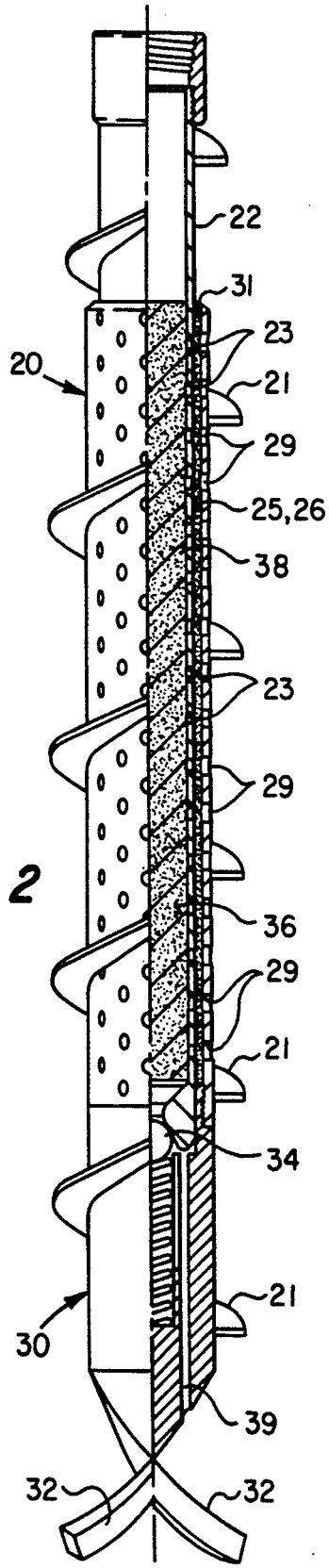
FIG. 2
FIG. 3
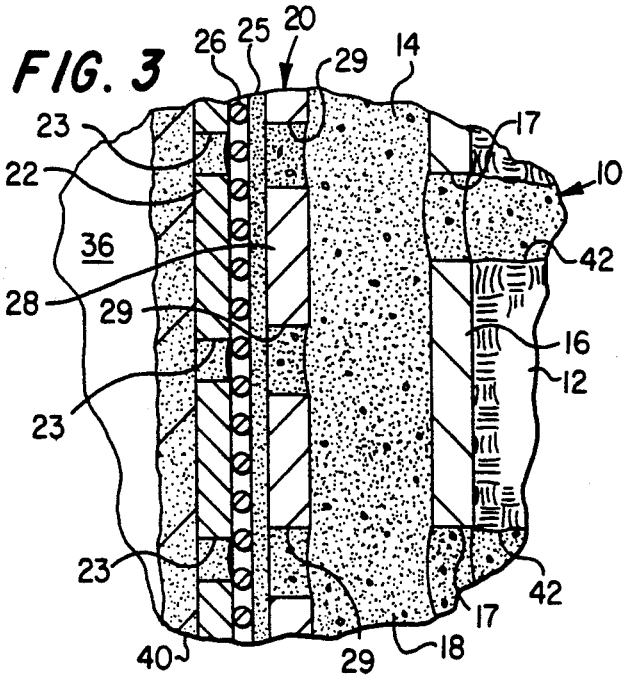

WELLBORE PRESSURE DIFFERENTIAL CONTROL FOR GRAVEL PACK SCREEN

BACKGROUND OF THE INVENTION

1. Field of the Invention

The present invention pertains to a gravel pack screen for fluid-producing wells which is modified to include a medium which will temporarily provide a barrier to fluid cross-flow in over- or under-balanced wells and similar situations.

2. Background Art

In the art of producing fluid from wells wherein gravel packing of the wellbore is required, or desirable, there are situations wherein the formation zone which is to be produced has a significant pressure gradient with respect to the distance along the wellbore. In such situations, a problem arises when attempting to install gravel pack screens of the auger type wherein wellbore fluids flow into the gravel pack screen at one location and, due to the pressure gradient along the gravel pack screen, tend to flow out of the screen at another location along the wellbore. This fluid cross-flow is undesirable and should be avoided at least during installation of gravel pack screens, such as of the auger type.

U.S. Pat. No. 5,063,920 to Cornette et al and assigned to the assignee of the present invention describes one improved gravel pack well completion having an auger-type gravel pack screen. U.S. Pat. No. 5,145,004, issued Sep. 8, 1992, and U.S. patent application Ser. No. 668,003, filed Mar. 12, 1991, both in the name of Holley M. Cornette and assigned to the assignee of the present invention describe certain other improvements in auger-type well gravel pack screens. These gravel pack screens as well as certain other types of gravel pack screens may be modified by the present invention to minimize the above-mentioned problem associated with auger-type well gravel packing completions.

SUMMARY OF THE INVENTION

The present invention provides an improved well gravel pack screen which is provided with a media to minimize the cross-flow of fluid through the screen during or after its installation into a well having a formation zone with a significant fluid pressure gradient or a well suffering from an under-balanced pressure condition.

In accordance with one aspect of the present invention, a gravel pack screen is provided with a quantity of media which will form an impermeable or almost impermeable barrier on the inside of the screen to control the flow of fluid from one point in a formation zone to another point in the formation through the gravel pack screen.

In accordance with another aspect of the present invention, there is provided a gravel pack screen having a substantially impermeable barrier provided therefor to minimize the cross-flow of wellbore fluids, which barrier is temporary and may be removed when desired. The barrier may comprise a graded particle slurry, a paste that may be dissolved, melted or sublimed at a predetermined time, a temporary gel or a low-permeability filler such as sand or other material which may be either washed out, dissolved or melted at a predetermined time.

The above-described features and advantages of the present invention as well as other superior aspects thereof may be further appreciated by those skilled in the art upon reading the detailed description which follows in conjunction with the drawing.

BRIEF DESCRIPTION OF THE DRAWING

FIG. 1 is a partial vertical section through an earth formation showing a well completion with an auger-type gravel pack screen in accordance with the present invention;

FIG. 2 is a partially sectioned elevation view of a gravel pack screen in accordance with the invention; and FIG. 3 is a detail view of an alternate embodiment of the impermeable filler material for use with a gravel pack screen according to the present invention.

DESCRIPTION OF PREFERRED EMBODIMENTS

In the description which follows, like elements are marked throughout the specification and drawing with the same reference numerals, respectively. The drawing figures are not necessarily to scale in the interest of clarity and conciseness.

Referring to FIG. 1, there is illustrated a vertical section of an earth formation 10 having a fluid-producing zone 12 penetrated by a wellbore 14 which is lined with a perforated metal casing 16. The casing 16 is provided with a plurality of spaced-apart perforations 17 in the zone of interest 12 so that fluid may be produced from the zone into the interior of the wellbore 14. In an effort to control the migration of sand and other fine particulates into the wellbore 14 and through any fluid carrying conduits therein, a quantity of gravel 18 is introduced into the wellbore in the zone of interest to serve as a filter to minimize the migration of sand and other particulates with the produced fluid.

In accordance with the invention in U.S. Pat. No. 5,036,920, a fluid-producing conduit system 19 includes an improved so-called gravel pack screen, a modified version of which is illustrated in FIG. 1 and generally designated by the numeral 20. The gravel pack screen 20 is provided with one or more helical flights 21 disposed on the exterior thereof so that the screen may be "augered" into the gravel 18 for final placement. The screen 20 is suitably connected to the conduit system or tubing string 19 which extends within the wellbore 14 for conducting produced fluid up through the tubing string to the surface, not shown. The portion of the wellbore 14 which is packed with gravel 18 is typically delimited by a suitable plug 15 disposed below the zone of interest 12.

In the course of installing the auger-type screen 20 in the wellbore 14, typically, the sand or gravel 18 is first placed in the wellbore throughout the zone of interest 12 which is perforated by the perforations 17 so that fluid flowing into the wellbore will undergo suitable filtration. Since the wellbore is already substantially full of liquid, in most instances, a pressure gradient exists which increases with wellbore depth and may be greater than the formation pressure at the perforations, thereby tending to cause fluid to flow through the gravel pack screen into the formation at the greater depth once the screen is in place. Moreover, in some wells, a pressure gradient occurs throughout the earth formation 10 within the zone of interest 12 which, when the zone is perforated, tends to permit flow of fluid through some of the lower perforations 17 into the wellbore 14, up through the wellbore and then back into the formation at a higher elevation through additional perforations 17 or simply on up through the wellbore itself. This tendency for fluid to flow in the directions described is aggravated during the installation of an auger-type screen such as the screen 20. For example, during augering in of the screen into the gravel 18, an upper portion of the screen, for example, is at a region of lower pressure than a lower portion of the screen. Since gravel pack screens may be as much as 100 feet in length, a considerable pressure differential may exist which would tend to produce fluid "cross-flow" from one portion of a formation to another or from one portion of a formation down or up through the wellbore. Accordingly, it is desirable to be able to at least temporarily prevent this type of fluid flow and, in some instances, seal the lower pressure region of the formation so that fluid will not flow from the inside of the screen back into the formation at the lower pressure region.

Referring now to FIG. 2, there are illustrated some details of the auger-type gravel pack screen 20 in accordance with the present invention. The screen 20 preferably includes a first elongated tubular member 22 which is provided with suitable perforations or slots 23 formed throughout a major portion of its length. The tubular member or liner 22 is adapted to have disposed on its periphery a suitable screen 25 which may be formed of a plurality of longitudinally-extending circumferentially spaced-apart screen wires 25 disposed over a continuously wound screen wire 26, see FIG. 3, which is wound directly on the outer surface of the liner 22. An outer, auger-flight-supporting and torque-transmitting sleeve 28 is disposed over the screen 25, 26 and is interconnected to the liner 22 at 31. The sleeve 28 is also suitably connected to a lower head assembly 30 comprising a so-called fishtail bit portion 32. A check valve 34, which may or may not be installed, permits flow of fluid through the interior space 36 of the screen 20 to the exterior at exit ports 39 but substantially prevents flow of fluid from the ports 39 into the interior space 36. The sleeve 28 is suitably provided with perforations 29 substantially throughout its length. Further details of the screen 20 are described in U.S. patent application Ser. No. 668,003. The annular space between the liner 22 and sleeve 28 may also be pre-packed with sand or similar filter media.

In accordance with the present invention, the interior space 36 of the screen 20 may be provided with a suitable filter material to minimize the type of fluid flow described hereinabove. For example, the space 36 may be filled with a wellbore circulation loss control material such as of a type commercially available from TBC-Brinadd, Division of Texas United Chemical Corporation, Houston, Tex. under the trademarks HYSAL-HD and PLUG-SAL. For example, HYSAL-HD is a blend of polymer, buffers and special fines sized salt having particle sizes ranging from 1.0 to 44 microns and PLUG-SAL is a specially sized and treated salt available in a wide distribution of particle sizes for bridging and sealing earth formations. The space 36 may be filled with a quantity of the above-described materials indicated by the numeral 38 in FIG. 2, prior to installing the auger screen 20 into the position illustrated in FIG. 1. By filling the space 36 with the material 38, there would be a tendency to form an impermeable or substantially impermeable filter cake across the perforations 23 and the screen 25, 26 to prevent flow of fluid from the space 36 outward into the formation if a pressure gradient was encountered within the wellbore 14 which would tend to cause such flow.

Alternatively, the material 38 may comprise a high viscosity fluid such as a cross-linked polymer gel of the type used for wellbore fluid loss control. Temblok 120 available from Halliburton Services, Duncan, Okla. is one example of a suitable material. Still further, the material 38 may comprise a low permeability filler such as 100 mesh or finer sand that may be either washed out or dissolved after the screen 20 is installed and the well is brought back into a pressure balanced condition. Further in accordance with the present invention, it is contemplated that the material 38 might comprise that which would flow through the gravel packing 18 and provide a filter cake which would minimize flow of fluid from the interior space 36 through the wellbore 14, the perforations 17 and into the formation.

An alternate arrangement for minimizing flow of fluid from the space 36 through the perforations 23 and into the gravel packing 18 would be to provide a layer of paste-like filler material 40, such as illustrated in FIG. 3, on the inside surface of the liner 22 and across the perforations 23. Such a material might be a calcium carbonate paste, for example, which could be easily installed within the liner 22 prior to installation of the screen 20 into the gravel packing. This paste 40 would substantially prevent flow of fluid from the space 36 outwardly through the perforations 23 but the paste could be dissolved at a later time by injecting through the conduit 19 a suitable fluid such as hydrochloric acid or other acids. The HYSAL-HD and PLUG-SAL salts can be removed in due course by circulation of fresh or under-saturated water to remove them from the space 36 once the screen 20 is completely installed. Devices such as disclosed in U.S. Pat. No. 4,671,359 to Renfro and U.S. Pat. No. 4,744,420 to Patterson et al, and assigned to the assignee of the present invention, could be used to remove undissolvable material 38 by entraining the material in a carrier fluid. Moreover, during or after installation of the screen 20, the aforementioned sealing materials 38 will flow toward the under-balanced portion of the zone 12 to plate out or form an impermeable filter cake either in the gravel packing 18 or in the formation faces such as in the faces of the perforation tunnels 42, FIG. 3. In this way, the undesirable cross-flow of fluid is minimized or prevented both during and after installation of an auger-type gravel pack screen.

Although preferred embodiments of the present invention have been described in detail herein, those skilled in the art will recognize that various substitutions and modifications may be made to the invention described without departing from the scope and spirit of the appended claims.

What is claimed is:

1. A method of minimizing cross-flow of fluid in a wellbore in an earth formation and fitted with a gravel packing and an auger-type gravel pack screen, comprising the steps of:

providing an auger-type gravel pack screen having a generally tubular liner member defining a space therewithin;

providing a quantity of wellbore fluid loss control material comprising a graded particulate salt disposed in said space which will provide a substantially impermeable barrier to the flow of fluid out of said space through said liner into said gravel packing and said earth formation;

filling at least a portion of said space with said material;

installing said screen in said gravel packing;

removing said material from said space after installation of said screen in said gravel packing by entraining said material in a carrier fluid while allowing at least some of said material to flow out of said space through said screen to form a filter cake on at least one of said gravel packing and said earth formation to minimize said cross-flow of fluid into said earth formation.

* * * * *